United States Patent [19]

Pollner

[11] Patent Number: 4,519,784

[45] Date of Patent: May 28, 1985

[54] METHOD OF INSERTING A CENTER ELECTRODE IN A SPARK PLUG INSULATOR

[75] Inventor: Rudolf Pollner, Bamberg, Fed. Rep. of Germany

[73] Assignee: Robert Bosch GmbH, Stuttgart, Fed. Rep. of Germany

[21] Appl. No.: 477,617

[22] Filed: Mar. 22, 1983

[30] Foreign Application Priority Data

Apr. 6, 1982 [DE] Fed. Rep. of Germany ..... 3212770

[51] Int. Cl.[3] ..... H01T 21/02

[52] U.S. Cl. ..... 445/7; 445/49

[58] Field of Search ..... 445/7, 49; 313/130, 313/141–142

[56] References Cited

U.S. PATENT DOCUMENTS

| | | | |
|---|---|---|---|
| 3,909,459 | 9/1975 | Friese et al. | 252/509 |
| 4,406,968 | 9/1983 | Friese et al. | 313/136 |
| 4,427,915 | 1/1984 | Nishio et al. | 445/7 X |

FOREIGN PATENT DOCUMENTS 3038649 10/1980 Fed. Rep. of Germany .

*Primary Examiner*—Kenneth J. Ramsey

*Attorney, Agent, or Firm*—Frishauf, Holtz, Goodman & Woodward

[57] ABSTRACT

To securely seat a ceramic electrode (23, 28) in an insulator (15) of a spark plug, so that it can be sintered together with the insulator, a ceramic plug element (28) has added thereto an additive which renders the ceramic plastically deformable upon application of external energy; the additive may, for example, be a thermoplastic, which permits plastic deformation upon application of heat; or a thixotropic agent, such as glycerin, rendering the material plastically deformable when vibrated. A pellet or plug (28) is introduced into the end portion (32) of the central opening (21) of the insulator, preshaped to be slightly smaller by, for example, 0.2 mm, than the clearance opening in the insulator. The plug is then rendered plastically deformable, compressed by a plunger (34/1) acting against a counter plate (33). Either the plug or the inner surface of the bore can be coated with a conductive coating (27) including a burn-spark-resistant metal, for example platinum, which, upon compression, is not electrically interrupted. In subsequent heating steps, the additive is vaporized-off, and the plug sintered to the ceramic body which, initially, was only presintered.

22 Claims, 3 Drawing Figures

METHOD OF INSERTING A CENTER ELECTRODE IN A SPARK PLUG INSULATOR

Reference to related patents and applications, assigned to the assignee of the present application, the disclosure of which is hereby incorporated by reference: U.S. Pat. No. 3,909,459, FRIESE et al; U.S. Ser. No. 297,353, filed Aug. 28, 1981, FRIESE and POLLNER, now U.S. Pat. No. 4,406,968. Reference to related patent: U.S. Pat. No. 4,427,915, NISHIO et al, to which: German Patent Disclosure Document DE-OS No. 30 38 649, corresponds.

The present invention relates to spark plugs, and more particularly to a method of inserting the center electrode into the center opening of a spark plug insulator, in which the center electrode is made of partly conductive ceramic material, which is coated or covered with an electrically conductive material which is highly resistant or degradation, or burning by sparking.

BACKGROUND

The referenced U.S. patent application Ser. No. 297,353, filed Aug. 28, 1981, FRIESE et al, describes a spark plug which has an insulator body in which a center electrode is inserted which is made of ceramic material. It has been found that difficulties arise in the manufacture of such spark plugs since gas-tight sinter connection between a ceramic pin, the surface of which carries an electrically conductive layer or coating, and the spark plug insulator was difficult. A relatively tight fit is required. Such tight fitting, and handling of the ceramic components with tight tolerances is difficult, since ceramic materials first shaped while in deformable state, upon sintering, have the tendency to shrink. Control of such shrinkage is very difficult and, thus, manufacture of ceramic elements which fit into each other with a tight fit is difficult to achieve. While the spark plugs, as described in the aforementioned application, provided excellent results, their manufacture under mass production conditions proved difficult and resulted in a commercially excessive number of rejects.

It has previously been proposed—see U.S. Pat. No. 4,427,915, to which German Patent Disclosure Document DE-OS No. 30 38 649, corresponds—to so construct a center electrode of a spark plug that a metal-ceramic composite material is pressed in the longitudinal bore of a raw insulating body in form of a pellet, and is then finish-sintered together with the insulating body, for complete sintering of the elements. The metal-ceramic composite material contains an additive, such as a binder, which is also used as the slipping material during pressing. Typical materials are varnish or paraffin. Spark plugs which have center electrodes made of a composite metal-ceramic material require high ignition voltages and, thus, are not suitable for many standard applications.

THE INVENTION

It is an object to improve the manfacture of spark plugs described, for example, in the referenced application Ser. No. 297,353, now U.S. Pat. No. 4,406,968, FRIESE and POLLNER, so that a commercially suitable process is obtained which results in few rejects in manufacture.

Briefly, a ceramic pin is provided which has an additive therein, for example a substance which makes the ceramic thixotropic, such as glycerin; a thermoplastic material, also, is used, for example forming a binder therefor. The ceramic pin is covered on at least a part of its circumference with an electrically conductive material highly resistant to being burned off by sparking, and has, prior to insertion into the central opening of a spark plug insulator, high form and shape retention, at even high room temperature, particularly when the pin, itself, is maintained at a low temperature.

The pin is inserted in the central opening, and then is fitted tightly in the central opening, for example by heating the pin, vibrating the pin, or otherwise affecting the pin, so that it will become plastically deformable. Upon plastification of the ceramic pin, the pin is deformed to fit tightly within the opening, for example by application of pressure applied by a plunger. The pin, as deformed, and with the surface coating of the spark-resistant material, is thus tightly seated within the opening of the spark plug insulator.

The so formed subassembly is then preheated to render the binder or glycerin volatile. Thereafter, the insulator and the pin inserted therein are sintered together, which also finish-sinters the insulator body.

The method has the advantage that gas-tight seating of the center electrode within the opening of the insulator body is insured. Only a neglectable number of rejects have been detected in actual operation. The requirement of ignition voltage for the finished spark plug is comparable to metal-electrode spark plugs, since the center pin will have a metal coating thereon, and conduction of electrical energy to the actual sparking area is not dependent on the material of the center electrode pin as such.

Preshaping the ceramic pins is simple, and the pins have good shape and form retention characteristics, so that they can be readily coated with an electrically conductive material, highly resistant to degradation by sparking, for example by dipping into a suspension of such electrically conductive material. Since the pins are stable in shape and form, they can be easily handled and treated, for example, by coating. A suitable coating material is platinum, or a platinum metal.

In accordance with a preferred feature of the invention, the originally non-conductive ceramic used for the ceramic pin has a thermoplastic material added thereto, or a material having thixotropic characteristics. The then resulting ceramic starting material provides for excellent shape and form retention of the pin, thus simplifying further handling and requiring only simple apparatus for further manufacture of the spark plug. The ceramic starting material for the ceramic pin can be press-formed to the required shape. The outer diameter of such a preshaped pin can be so arranged that it can be readily fitted within the longitudinal opening of a spark plug insulator, without damage to the electrically conductive coating thereon.

DRAWINGS

DETAILED DESCRIPTION

Figure 1:
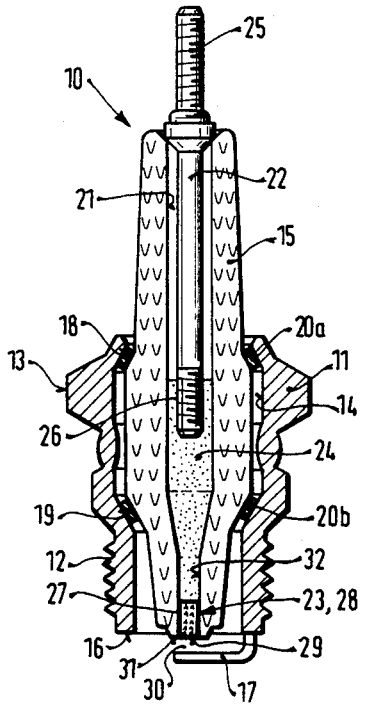
FIG. 1 is a longitudinal sectional view through a spark plug made in accordance with the method of the present invention, shown to an enlarged scale.
Figure 2:
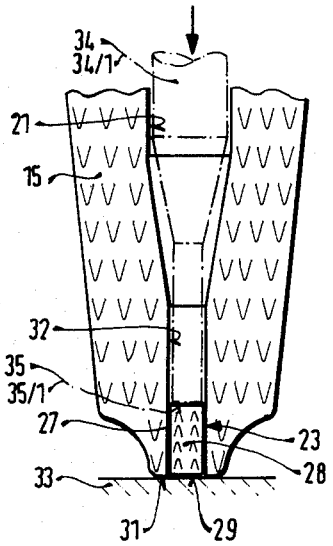
FIG. 2 is a highly enlarged fragmentary view of the end portion of the spark plug insulator, in which the center electrode already is fitted.

The spark plug shown in FIGS. 1 and 2 has a metallic housing 11, formed at its outer circumference with the customary thread 12 and a hexagonal gripping surface 13 to receive a spark plug socket wrench, to permit installation of the spark plug in a tapped opening formed in the wall of the combustion chamber of an internal combustion (IC) engine, not shown. The housing 11 is tubular, and its inner opening 14 retains the major portion of an essentially tublar insulator 15. The insulator extends from a connecting end portion to the ignition end portion. The ignition end portion of the housing 11 had an end face 16 on which a ground or counter electrode 17 is secured, extending in form of a hook towards or over the center line of the spark plug. More than one such ground or counter electrode 17 may be provided. The insulator 15 is formed at its outer circumference with shoulders 18, 19 which permit fitting the insulator in the housing 11 by engagement of the shoulders with sealing rings 20*a*, 20*b*, and rolling-over, or otherwise deforming the housing, and retaining the insulator 15 securely and sealed therein. Use of heat-shrink methods, as well known, insures a tight and sealed connection of the insulator to metal housing. The insulator 15 may be otherwise secured in the housing 11, for example by ceramic-to-metal cements, or the like.

The longitudinal opening 21 of the insulator body retains a connecting post 22 and a center electrode 23. The ends of the connecting post 22 and of the center electrode 23, which face each other, are electrically connected through an electrically conductive sealing mass 24. Such sealing masses are known—see, for example, U.S. Pat. No. 3,909,459, FRIESE et al, assigned to the assignee of the present application. The connecting post 22 has a thread 25 at its outer end to permit connection of the post to a high-voltage spark plug cable—not shown—or any other suitable terminal connection. The other end of the post 22 is formed with a thread 26 to insure that the post will be securely retained in the electrically conductive sealing mass 24.

The insulating body 15, preferably, is made of a sintered ceramic material such as aluminum oxide. The center electrode 23 includes an electrically conductive, spark, burn-off and heat resistant layer or coating 27 and a ceramic pin 28. The electrically conductive layer or coating 27, usually, is made of a platinum-type metal, such as platinum itself, and, in a preferred embodiment, includes some ceramic components, for example about 35%, by volume, aluminum oxide. This electrically conductive layer 27, in the example shown, is applied to the surface of the ceramic pin 28. The layer 27 has a layer thickness of, for example, about 0.03 mm; depending on the use to which the spark plug is to be put, and the type of engine in which it is to be installed, the thickness of the layer may vary widely, for example between 0.005 and 0.05 mm. The electrically conductive layer 27 is in electrically conductive relation to the electrically conductive sealing mass 24 and, hence, to the connecting post 22. At the ignition facing surface 29 of the ceramic pin 28, the electrically conductive layer forms the counter terminal to the ground or counter electrode 17, spaced therefrom by the spark gap 30, which faces the surface 29.

In the example shown in FIGS. 1 and 2, the surface 29 is flush with the surface 31 of the insulating body 15. Depending on the use and type of engine with which the spark plug is to be used, the ceramic pin 28, and with it the conductive coating 27, can extend from the longitudinal opening 21 of the insulator 15, or a projecting button or head may be applied thereto.

The center electrode 23, and on it the electrically conductive layer, can be constructed in accordance with various design requirements placed on spark plugs. For example, and as described in the aforementioned copending application Ser. No. 297,353, filed Aug. 28, 1981, FRIESE and POLLNER, now U.S. Pat. No. 4,406,968, a resistance element may be formed on the surface of the ceramic pin 28; also, the structure may be so arranged that a pre-spark gap path is formed. The conductive layer 27 need not cover the entire facing surface 29 of the ceramic pin 28, or any part of it, if, for example, the pin projects slightly from the insulator to provide an exposed lateral conductive surface, or the electrically conductive layer is otherwise exposed to form a spark gap with the counter electrode.

The ceramic pin 28 is made of a material which has a thermal coefficient of expansion which, generally, matches the thermal coefficient of expansion of the insulator 15. Preferably, it consists of essentially the same aluminum oxide as that of the insulator 15. Making the pin 28 and the insulator 15 of the same, or at least essentially the same material, results in another desirable characteristic for the finished spark plug. The material shrinkage, or contraction, of the pin 28 and the insulator 15, upon sintering, will then also be essentially the same.

The starting material for the ceramic pin 28, preferably, is essentially aluminum oxide. Additionally, flux additives such as, for example, calcium oxide or silicon oxide, present in about 5% by weight, for example, may be added.

In accordance with a feature of the invention, a further additive is included in the material of the ceramic pin 28, namely an additive which renders the ceramic starting material of the pin 28 essentially rigid, so that the material can be easily handled. This additive permits the pin 28 to retain its shape or form as it is being made, for example by extrusion, even at comparatively high room temperatures, and especially if the pin 28 is retained at low temperature. Yet, the additive should have the characteristic that it permits the ceramic material to become plastically deformable during the manufacturing process by application of external energy in well known and easily available and applicable form, for example heat, vibration, or the like.

In accordance with a feature of the invention, then, the ceramic pin 28—besides the flux additive—contains an additive of a thermoplastic material of the following composition (all percentages by weight):

18% resin SK (available from Chemical Works Hüls AG)
41% polyvinyl acetate
10% rapeseed oil-base fatty acid
14% dibutylphtalate
17% gas oil.

The foregoing additive mixture is added to the ceramic base material at a ratio of about 18%—by weight—of mixture to the base material of ceramic and flux, typically 95% aluminum oxide and about 5% flux (by weight).

The foregoing additive is a thermoplastic mixture which renders the material of the pin 28 plastically deformable when external enery such as heat is applied thereto.

In accordance with another feature of the invention, the additive may be a material which renders the ceramic-flux base material thixotropic; a suitable material 22%, by weight, with reference to the ceramic-flux base mass of glycerin, as will be explained in detail below with reference to FIG. 3. The glycerin added is, for example, about 22% (by weight) with respect to the ceramic base mass, including the flux material. The external energy then, preferably, is vibration, as will be explained in detail below with reference to FIG. 3.

Assembly of center electrode 23 in the insulator 15, with reference to FIGS. 1 and 2: The insulator 15, preferably made of aluminum oxide with about 5% (by weight) of flux additive, has a longitudinal bore 21. It is presintered, for example in a furnace at about 1000° C. After presintering, the end portion 32 of the longitudinal opening 21 of the ceramic body, which is to receive the center electrode 23, has a nominal diameter of 1.2 mm. The center electrode 23, shaped, for example, by extrusion, is introduced into this end portion 32 of the longitudinal opening of the insulator body 21. Preferably, the introduction of the pin 23 is from the inside, that is, from the connecting terminal end of the longitudinal opening 21, by a suitable insertion step, or tool, as will appear.

The ceramic pin 28, forming the center electrode 23, is made of aluminum oxide which, in addition to the above referred-to flux additive has the thermoplastic additive material therein. The shape of the composite ceramic pin 28 is obtained by axial pressure in a press which, preferably, is somewhat heated to, for example, about 100° C.; other methods, such as thermoplastic casting, or extrusion, may be used.

The electrically conductive coating 27 is made by providing a suspension of platinum and aluminum oxide—in which the aluminum oxide is present in the proportion of about 20%, by volume. The composite ceramic pin is dipped into the platinum-aluminum oxide suspension, and dried, so that the spark and burn-off resistant layer 27 will be applied to the pin 28. The pin 28 has a length of about 2 mm. The outer diameter of this pin, at this stage of the manufacture, including the layer 27, is about 1.0 mm, and thus is about 0.2 mm smaller in outer diameter than the clear diameter of the end portion 32 of the opening 21 in the insulator body 15. The difference in diameter between the clear dimension of the end portion 32 in the opening 31 of the insulator and the raw center electrode 23 is, preferably, between about 0.1 and 0.3 mm, and the dimensions can be varied, suitably, to provide for this difference.

The suspension need not contain platinum and aluminum oxide as stated in the preferred embodiment; rather than using platinum, other platinum metals, or, for that matter, other suitable and known metals, or electrically conductive metal oxides which have the characteristic of resistance to high temperatures, decomposition or deterioration under sparking, and the like, may be used. The viscosity of the suspension should be so arranged that the layer 27, when the spark plug is sintered, has a thickness of between about 0.005 and 0.05 mm.

The apparatus to insert the center electrode pin 28, with the coating 27 thereon, is simple. An apparatus—not further shown in detail—has a receiving or closing plate 33, shown in chain-dotted representation in FIG. 2. It is applied flush against the end surface 31 of the insulator 15, and thus closes the ignition end portion of the longitudinal opening 21 within the insulator 15. The center electrode 23—see FIGS. 2 and 3—can be inserted by forming a plunger 34 with a small, fine projecting pin—not shown in FIGS. 2, 3—on which the center electrode 23 is impaled, and introducing the plunger 34, with the center electrode 23 secured thereon by the pin projecting from the front facing surface 35 of the plunger, from the terminal end portion lengthwise through the center bore into the ignition end portion 32 of the opening 21, until the center electrode 23 is fitted flush against the closing plate 33. In case it is desired to have the center electrode 23 project from the insulator 15, the closing plate 33 is preferably formed with a corresponding recess—not shown. This recess may be cylindrical, part-spherical, or otherwise shaped to permit projection of the center electrode 23 from the end face surface 31 of the insulator 15. A stripper, for example a stripping sleeve—not shown, and as well known in structures of this type—is used to sever the center electrode 23 from the impaling pin projecting from the surface 35 of the plunger 34.

The second major production step is provided to render the center electrode 23 plastically deformable. Thus, the presintered insulator 15, together with the center electrode 23 inserted therein, is introduced into a furnace or heater, and heated to a temperature in which the thermoplastic additive becomes fluid or readily deformable; a suitable temperature is 160° C. Thus, by introducing the subassembly of presintered insulator 15 and the center electrode 23 therein into a furnace of 160° C., the thermoplastic material, and hence the initially introduced element of the center electrode 23 will become plastically deformable.

The third major manufacturing step comprises securely seating the center electrode 23 in the insulator. A plunger 34/1 which, generally, may have the shape of the plunger 34, is introduced into the longitudinal opening 21 of the insulator 15. The plunger has a facing end surface 35/1, which engages the now plastically deformable center electrode 23, and is applied thereagainst with such pressure that the center electrode will fit tightly against the inner surface of the longitudinal opening 21. A suitable pressure force is, in the example given, about 18 Newton, suitable for a center electrode 23 of about 2 mm length. The electrically conductive layer 27, applied to the pin 28, will retain its functional characteristics during this compression or deformation step. Thus, the electrode will have a continuous electrically conductive layer 27 thereon, although the core portion formed by the ceramic-plastic composition will be deformed.

The fourth major production step comprises rendering the thermoplastic material volatile and removing it from the center electrode. In this fourth step, the center electrode 23—now deformed—within the insulating body 15, is heated, slowly, to a temperature of about 400° C., so that the organic materials, including the themoplastic material, which were introduced into the ceramic pin 28 to maintain its shape and form stability, will be rendered volatile, and will vaporize. The heating should be carried out gradually; a temperature gradient of about 50° C. per hour should, preferably, not be exceeded.

The fifth major production step then is to sinter together the insulator 15 and the center electrode 23. The center electrodes, within the insulator 15, are introduced into a sintering furnace and sintered together at a temperature of about 1600° C.

The remaining construction of steps of manufacture of the spark plug will be carried out in accordance with well known procedures—filling the insulating sealing mass 24, introducing the connecting post 22, and joining the insulator to the metal housing, can be carried out in accordance with well known and standard production processes.

Figure 3:
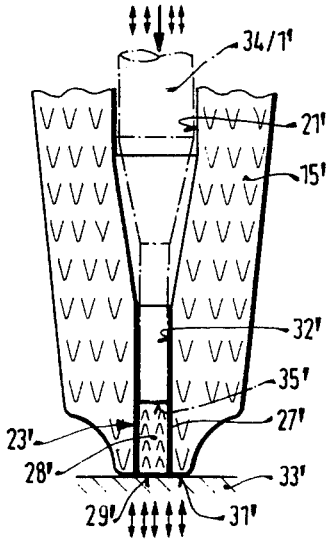
FIG. 3 is a view similar to FIG. 2, illustrating another embodiment of a center electrode.

Process of manufacture, second embodiment, with reference to FIG. 3: The center electrode 23' is fitted into the end portion 32' of the longitudinal aperture 21' of the insulator 15'. First, a ceramic plug element 28' is made which can be formed of the same ceramic material with the flux as in the example discussed in connection with FIG. 2. Rather than using the plastic additive, however, an additive is used which renders the ceramic—flux combination thixotropic. FIG. 3 illustrates also a different embodiment of the method and structure in that the suspension for the electrically conductive layer 27' is not applied to the ceramic plug but, rather, to the inner surface of the end portion 32' adjacent the ignition within the longitudinal opening 21' of the insulator. Thus, the ceramic plug 28' need not have the electrically conductive layer 27' applied thereto. The same feature may, of course, also be used in the embodiment of FIG. 2. The suspension can be applied by, for example, pouring the suspension through the center opening 21'. Preferably, the suspension is applied to the surface of the entire ignition-side end portion 32' of the longitudinal bore 21' of the presintered insulator 15'.

The finished center electrode 23' will bond or sinter to the insulator and through the coating formed by the suspension. Reliable electrical contact with the electrically conductive sealing mass 24—not shown in FIGS. 2 and 3—is insured by the coating on end portion 32.

The ceramic pin 28', which is form-stable and, thus, retains its shape for insertion, is plasticized by applying a vibrating plate 33' against the plug 28'. Vibration of the plate 33' is schematically indicated by the group of double arrows at the bottom of FIG. 3. Equivalent structures to effect vibration may be used.

A plug 34/1', which is used to press the ceramic pin 28' within the opening 21', likewise, preferably, is vibrated during the compression stage, when the plug is deformed.

Manufacturing steps, with reference to FIG. 3: The presintered insulating body 15', identical to the construction in connection with FIG. 2, has a layer 27' applied at the ignition end portion 32' of the longitudinal aperture or opening 21'. Preferably, the coating 27' is applied as a suspension, which contains platinum and a ceramic material. The suspension can be identical to that discussed in connection with FIG. 2. The suspension which results in the electrically conductive layer or coating 27' is applied by permitting the suspension to flow through the entire ignition end portion 32' of the longitudinal opening 21' of the insulator 15', so that the suspension will coat the interior of the portion 32'. The viscosity of the suspension which will form the conductive layer 27' is so arranged that the electrically conductive layer 27', when finished, will have a thickness of between 0.005 and 0.05 mm, preferably about 0.03 mm. The thickness is to be selected in accordance with the use to which the spark plug is to be put, and, for example, the type of engine with which it is to be used.

A ceramic mixture is prepared, for example the same aluminum oxide and the same flux from which the plug 28 of FIG. 2 is made, in order to prepare the ceramic pin or plug 28'. The insulator 15', again, can be made of the same material as the insulator 15 (FIG. 2). In contrast to the material of which the plug 28 is finally made, the additive for the plug or pin 28' is a material which renders the mixture thixotropic. Such an additive, for example, is glycerin, which is, preferably, added in the amount of about 22% (by weight), with respect to the ceramic-flux combination.

The ceramic pin 28' is made in form of small plug elements and inserted into the ignition end portion 32' of the opening 21'. The length of the plug, for example, is about 2.5 mm, and it is made with a diameter which is about 0.2 mm smaller than the clear diameter of the longitudinal opening 21' in the region of the ignition end portion 32'. In an operative embodiment, the end portion 32' of the longitudinal opening 21' has a diameter of 1.2 mm, and the diameter of the ceramic pin 28' is 1.0 mm. The pin 28' is inserted into the end portion 32' in a manner similar to that explained in connection with FIG. 2—by impaling the plug 28' on a fine need-like projecting pin on a plunger 34, and introducing it from the connecting end portion through the opening 21' to the end portion 32'. It is, however, also possible to directly introduce a plug element from an extruder, cut directly from the extrusion apparatus into the opening portion 32', or to insert a pellet of predetermined size and mass into the longitudinal bore 21', for example from the connecting end portion, by dropping it in, or from the ignition end portion.

The insulating body 15' had already before the coating or layer of electrically conductive material 27' applied to the end portion 32' of the central opening 21'. The insulating body 15', so coated, and with the ceramic pin or plug 28' introduced into the longitudinal aperature 21', is then placed on a counter plate or receiver 33', and held thereagainst by a suitable jig (not shown), for example such that the end surface 31' of the insulator 15' as well as the surface 29' of the ceramic plug 28' are engaged by the plate 33'. The plate 33' is then vibrated by a suitable vibrator, in accordance with well known vibrating technology, and thus causes the ceramic material 28' to become plastic. When the pin or plug 28' has reached a suitable plastic state, a next production step is initiated. While maintaining the vibration, as schematically indicated by the multiple arrows beneath the plate 33', a plunger is introduced from the terminal end into the longitudinal opening 21' of the insulating body 15'; this plunger 34/1' is also vibrated, and, additionally, loaded with pressure to press the now plastically deformable ceramic material of the ceramic plug or pin 28' towards the plate 33'. This compression is continued until the material of the plug 28' is securely seated in the end portion 32' of the central opening 21' in the insulator 15'. The pressure which is applied can be comparable to that of the method used in FIG. 2, e.g. for example about 18 Newton.

The next steps are similar to those of the process described in connection with FIG. 2. By application of heat, the additive within the ceramic pin 28' is vaporized, the presintered insulator 15' and the remaining material of the ceramic plug 28' are finally sintered and, respectively, sintered together with the ceramic insulator 15'. The electrically conductive layer 27' will form an exposed metallic ring zone at the ignition end surface 31' of the insulator 15'.

Assembly of the insulators 15, 15' into the metal housing 11 can be carried out in accordance with any well known spark manufacturing procedured.

Various changes and modifications may be made, and method steps described in connection with any one of the embodiments may also be used in the other. For example, the additive to the ceramic material forming the plug 28, in which the plug is coated as described in connection with FIG. 2, may be glycerin. The energy which is then supplied to render the plug plastically deformable will be vibration, so that the thixotropic ceramic can be deformed by the plunger 34/1. Similarly, the plug 28', FIG. 3, may be coated with a conductive suspension as described in connection with FIG. 2, rather than coating the interior of the end portion 32' of the central bore 21'. The plug may also be similar to the plug 28, that is, including a plastic additive. In accordance with a suitable and preferred process, the ceramic tip 28 can be made by thermoplastic-extrusion-pressing ceramic material which has the thermoplastic additive therein directly into the end portion 32' of the longitudinal bore 21', and closing off that end portion 32' from the terminal end by a plunger, for example, so that manufacture of the plug 28' as a separate discrete element which has to be handled separately can be avoided. The plug, thus, is formed directly upon introduction into the end portion 32', followed by vibration and compaction for secure and tight seating within the opening 32'. To plasticize such a ceramic element, introduced into an opening precoated with the layer 27', use of a ceramic mass with a thermoplastic additive—as explained in connection with FIG. 2—is desirable, and the plug is then rendered plastically deformable by heat in a suitable furnace. Vibration, for example, may be applied at a frequency of 50 Hz with an excursion of 0.3 mm.

Various other changes and modifications may be made within the scope of the inventive concept.

I claim:

1. Method of inserting a center electrode (23, 23') in an insulator body (15, 15') of a spark plug having a terminal end portion and an ignition end portion, in which the spark plug has a metal body (11) formed with a central opening, the insulator body (15) is secured in the central opening of the metal body, and the insulator body is formed with a central aperture or opening or bore (21, 21');

a connection terminal post (22, 25) located in the central opening of the insulator body and extending outwardly thereof at the terminal end portion of the spark plug;

conductive means (24) positioned in the central bore, mechanically and electrically connected to the terminal post;

the center electrode (23, 23') being located in the central opening of the insulator, adjacent the ignition end portion, in electrically conductive connection with the conductive means (24), the center electrode including a body (28, 28') having an outer surface;

the insulator body (15, 15') having an inner surface (32, 32') adjacent said outer surface;

a heat-resistant, electrically conductive coating or layer (27, 27') located on at least some of the surface areas of at least one of said surfaces, and in electrical connection with said conductive means (24), said center electrode and said insulator body (15) consisting of elements of ceramic material, which materials, upon heating to sintering temperature, are subject to material shrinkage, and which materials have essentially similar temperature coefficients of expansion, said method comprising the steps of (a) providing a ceramic body (28, 28') of the ceramic material of the center electrode, in unsintered condition, and including a heat-volatile additive therein which makes said ceramic body form and shape retentive at room temperature, but permitting plastic deformation under application of external energy thereto;

(a-1) presintering the insulator body (15, 15') to establish the shape thereof;

(a-2) applying said electrically conductive coating or layer to one of said surfaces;

(a-3) introducing said ceramic body (28, 28') into the end portion (32, 32') of the central bore (21) of the insulating body (15);

(b) applying external energy to said ceramic body (28, 28') to render said ceramic body plastically deformable;

(c) deforming said ceramic body (28, 28') while in plastically deformable condition and while positioned in the end portion (32, 32') of the opening (21, 21') of the insulator body, to completely fill said opening and to engage said surfaces, with the heat-resistant electrically conductive coating or layer interposed;

(d) heating the ceramic body (28, 28') to render volatile said additive and thereby remove the additive from the ceramic body; and (e) finish sintering, and sintering together said presintered insulating body (15) and the ceramic body (28, 28') with the heat-resistant electrically conductive coating or layer (27, 27') therebetween.

2. Method according to claim 1, wherein the heat volatile additive comprises a thermoplastic material;

and the step of applying external energy comprises heating said ceramic body while inserted in the end portion (32) of the central bore (21) of the insulator.

3. Method according to claim 2, wherein said step of deforming the plastically deformable ceramic body (28, 28'), while inside the end portion (32, 32') of the central opening or aperture (21, 21') of the insulator (15, 15'), comprises compacting and compressing the ceramic body within the end portion of the opening.

4. Method according to claim 2, wherein said step of applying heat to the ceramic body, inserted into the presintered insulating body (15), comprises heating said ceramic body to a temperature at which the thermoplastic material becomes flowable.

5. Method according to claim 4, wherein said temperature is in the order of about 160° C.

6. Method according to claim 2, wherein said step of deforming the plastically deformable ceramic (28, 28'), while inside the end portion (32, 32') of the central opening or aperture (21, 21') of the insulator (15, 15'), comprises applying a plunger (34/1, 34/1') through said opening or bore of the insulator against the ceramic body (28, 28') which has been rendered plastically deformable, and providing a counter surface or counter pressure area (33, 33') directed towards the end face (29, 29') of said ceramic body (28, 28') to compresss the ceramic body within the end portion of the opening.

7. Method according to claim 1, wherein the heat volatile additive comprises a substance rendering the ceramic body thixotropic;

and the step of applying external energy comprises vibrating the plug body (28') while inserted in the end portion (32') of the central opening (21') of the insulator (15').

8. Method according to claim 3, wherein the additive comprises glycerin.

9. Method according to claim 7, wherein said step of deforming the plastically deformable ceramic body (28, 28'), while inside the end portion (32, 32') of the central opening or aperture (21, 21') of the insulator (15, 15'), comprises compacting and compressing the ceramic body within the end portion of the opening;

and continuing to apply said vibrating external energy while compressing and compacting said ceramic body (28').

10. Method according to claim 1, wherein the step of applying external energy comprises heating said ceramic plug body.

11. Method according to claim 1, wherein the step of applying external energy comprises vibrating said ceramic body.

12. Method according to claim 1, wherein the step of applying the heat-resistant electrically conductive coating or layer (27) comprises applying a heat, spark, and burn-resistant metal on the outer surface of the ceramic body (28).

13. Method according to claim 1, wherein the step of applying the heat-resistant electrically conductive coating or layer (27) comprises applying a heat, spark, and burn-resistant metal to the inner surface of the end portion (32) of the opening or aperture (21') of the insulator (15').

14. Method according to claim 1, wherein the step of applying the heat-resistant electrically conductive coating or layer (27, 27') comprises forming a suspension of a heat-resistant, burn and spark-resistant platinum-type metal and ceramic;

coating the respective surface with said suspension;

and permitting said coated surface with the suspension thereon to dry.

15. Method according to claim 1, wherein the step of introducing said ceramic body (28) into the end portion (32) of the central bore (21) of the insulator body (15) comprises shaping the ceramic body to have an outer configuration similar to the end portion of the opening in the insulator, but slightly smaller;

and mechanically inserting the ceramic body into said opening.

16. Method according to claim 1, wherein the step of introducing the ceramic body (28) into the end portion (32) of the central bore (21) comprises forming the ceramic material of the ceramic body into an essentially cylindrical plug or pellet of predetermined size and dimension, with a cross section slightly smaller than the clear diameter of the end portion of the opening;

and pushing said ceramic body into the opening.

17. Method according to claim 11, wherein the outer diameter of the ceramic body or pellet is between about 0.1 to 0.3 mm smaller than the diameter of the end portion (32) of the opening (21) in the insulator.

18. Method according to claim 1, wherein the material which is added comprises a thermoplastic material;

and the step of heating the ceramic body (28) to render said additive volatile comprises gradually heating the insulator (15) with the ceramic body (28, 28') inserted therein to a temperature sufficient to render the thermoplastic material volatile at a heating rate of up to about 50° C. per hour.

19. Method according to claim 1, wherein the additive which is heat volatile comprises a material rendering said ceramic body (28, 28') thixotropic.

20. Method according to claim 1, wherein said step of deforming the plastically deformable ceramic body (28, 28'), while inside the end portion (32, 32') of the central opening or aperture (21, 21') of the insulator (15, 15'), comprises applying a plunger (34/1, 34/1') through said opening or bore of the insulator against the ceramic body (28, 28') which has been rendered plastically deformable, and providing a counter surface or counter pressure area (33, 33') directed towards the end face (29, 29') of said ceramic body (28, 28') to compress the ceramic body within the end portion of the opening.

21. Method according to claim 20, wherein the step of applying external energy to render said ceramic body (28, 28') plastically deformable comprises applying at least one of:

heat;

vibrating energy.

22. Method according to claim 1, wherein said step of deforming the plastically deformable ceramic body (28, 28'), while inside the end portion (32, 32') of the central opening or aperture (21, 21') of the insulator (15, 15'), comprises compacting and compressing the ceramic body within the end portion of the opening.

* * * * *

UNITED STATES PATENT AND TRADEMARK OFFICE

CERTIFICATE OF CORRECTION

PATENT NO. : 4,519,784

DATED : May 28, 1985

INVENTOR(S) : Rudolf POLLNER

It is certified that error appears in the above-identified patent and that said Letters Patent is hereby corrected as shown below:

Claim 17, line 1, change "claim 11" to -- claim 16 --

Signed and Sealed this

*Thirty-first* Day of *December 1985*

[SEAL]

*Attest:*

DONALD J. QUIGG

*Attesting Officer*

*Commissioner of Patents and Trademarks*